United States Patent [19]

Deforeit

[11] 4,344,343

[45] Aug. 17, 1982

[54] POLYPHONIC DIGITAL SYNTHESIZER OF PERIODIC SIGNALS

[76] Inventor: Christian T. Deforeit, 202 rue des Joncs-Marins, 91620 La Ville Du Bois, France

[21] Appl. No.: 158,251

[22] Filed: Jun. 10, 1980

[30] Foreign Application Priority Data

Jun. 15, 1979 [FR] France ..... 79 15337

[51] Int. Cl.[3] ..... G10H 1/00

[52] U.S. Cl. ..... 84/1.01; 84/1.19

[58] Field of Search ..... 84/1.01, 1.26, 1.03, 84/1.19, 1.24; 364/723

[56] References Cited

U.S. PATENT DOCUMENTS

| | | | |
|---|---|---|---|
| 4,036,096 | 7/1977 | Tomisawa et al. | 84/1.01 |
| 4,128,032 | 12/1978 | Wada et al. | 84/1.01 |
| 4,205,575 | 6/1980 | Hoskinson et al. | 84/1.01 |
| 4,245,541 | 1/1981 | Deutsch | 364/723 X |

*Primary Examiner*—J. V. Truhe
*Assistant Examiner*—Forester W. Isen
*Attorney, Agent, or Firm*—Oblon, Fisher, Spivak, McClelland & Maier

[57] ABSTRACT

An entirely digital polyphonic musical synthesizer in which the amplitude of each spectral component may develop either linearly or logarithmically as a function of time, including amplitude computation means which produce, for each period of an amplitude clock signal, a new current amplitude value by linear or logarithmic interpolation between the initial current amplitude and a predetermined final amplitude value. The new current amplitude value is memorized in place of the initial value. When the current amplitude is equal to the final amplitude, a signal is transmitted to the synthesizer control means. The synthesizer enables gentle modulations in amplitude to be obtained and reduces the complexity of the instrument's control means.

7 Claims, 5 Drawing Figures

POLYPHONIC DIGITAL SYNTHESIZER OF PERIODIC SIGNALS

CROSS-REFERENCE TO RELATED APPLICATIONS

This invention is related to the technology disclosed in my related U.S. Patent Applications Ser. No. 918,576 filed July 24, 1978, and Ser. No. 092,468 filed Nov. 8, 1979.

BACKGROUND OF THE INVENTION

1. Field of the Invention

This invention relates to a polyphonic digital synthesizer of periodic signals for the production of musical sound. More particularly, it concerns entirely digital synthesizers in which each periodic signal results from a succession of digital samples produced in particular from a wave form sample memory read at variable frequency and then converted into analog form.

2. Description of the Prior Art

Such synthesizers have already been described in French patent applications Nos. 7607419 of Mar. 16, 1976, 7720245 of July 1, 1977, 7832727 of Nov. 21, 1978, and in first certificate of addition number 7907339 of Mar. 23, 1979.

Each sample is produced from a set of digital data such as instantaneous phase, current amplitude (signal envelope), harmonic or octave row, analog output path, etc., which are stored in a block of memories. Each sample therefore results from the reading of a block of memories. This same block is the source of a complete periodic signal, by virtue of the periodic reading of this block and simultaneous updating of the instantaneous phase datum which it contains.

All of the samples of all of the periodic signals are produced sequentially and cyclically in a series which results from connecting the reading of the memory blocks.

Given that a complex output sound can be considered as the sum of a certain number of elementary periodic signals, e.g. sinusoidal, and given the polyphonic nature of the synthesizer, there are numerous memory blocks organized into an assembly called the "virtual keyboard." The synthesizer thereby generates a great number of signals automatically using the data inscribed in the "virtual keyboard."

To make up a complete musical instrument, such as an electric organ, the synthesizer is connected to keyboards, pedals, buttons, stops, and control means which register the data necessary for the generation of signals in the "virtual keyboard," according to actions taken with the keys, buttons, pedals, and stops, and as a function of time. In a quality musical instrument in particular, the development over time of the amplitude of each sound component must be made with great precision and according to given principles. But this need involves considerable work by the control means of the instrument, as well as great complexity of such means and a high cost for the circuits which compose them.

SUMMARY OF THE INVENTION

Accordingly, one object of this invention is to provide a novel synthesizer which avoids the above-noted problem by considerably simplifying the work performed by the control means with regard to the control of the development of each sound component (or periodic signal).

Another object of the present invention is a new synthesizer in which the amplitude of each sound component is capable of developing automatically over time between an initial running value and a given final value, according to a given principle, and of doing so without intervention of the instrument's control means, at least until the final amplitude value has been reached.

According to one characteristic of the invention, the synthesizer comprises:

plural generators of rectangular signals of given frequencies;

a set of memory blocks containing at least instantaneous phase data, octave or harmonic row data, and amplitude data;

control means for reading the memory blocks sequentially and in a given series which is a function of the generator signals;

means for producing analog samples of periodic signals from the data read in the blocks; and means for automatically developing, as a function of time, the amplitude of each periodic signal, comprising computation means for periodically replacing the amplitude datum of each block which contains one with a new amplitude datum computed by interpolation between the initial amplitude and a predetermined final amplitude.

For example, one or more amplitude clock generators determine the rhythm of computation of the new amplitude values.

According to another characteristic of the invention, each block containing a running amplitude datum further contains a final amplitude datum which serves periodically for the computation of the new running amplitude. The development of the amplitudes of the different periodic signals is thus mutually independent.

According to the invention, therefore, the amplitude datum in the virtual keyboard block is automatically modified at the rhythm of the amplitude clock (very low frequency) according to an essentially linear or logarithmic interpolation. The logarithmic (or exponential) interpolation, in particular, enables a very gentle and natural development of the amplitude between the initial and final values to be obtained, without the listener sensing a stepwise amplitude development. The amplitude clock is completely independent of the rectangular signal generators which determine the frequencies of the elementary tones. Several amplitude clocks are even desirable so as to make available a great variety of amplitude development speeds.

Given that this amplitude development is carried out automatically by the synthesizer, the instrument's control means are now required only to furnish several points of the amplitude envelope curve of the periodic output signals, which simplifies the task of the control means considerably and enables the general qualities of the instrument to be greatly improved.

According to a preferred embodiment of the invention, the means used for automatic development of amplitude may be common with other of the synthesizer's computational means, limiting the complexity of the circuits. These means may also be blocked at any time by the instrument's outside control means, thus suspending automatic operation and leaving the possibility of creating special effects to the instrument control means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
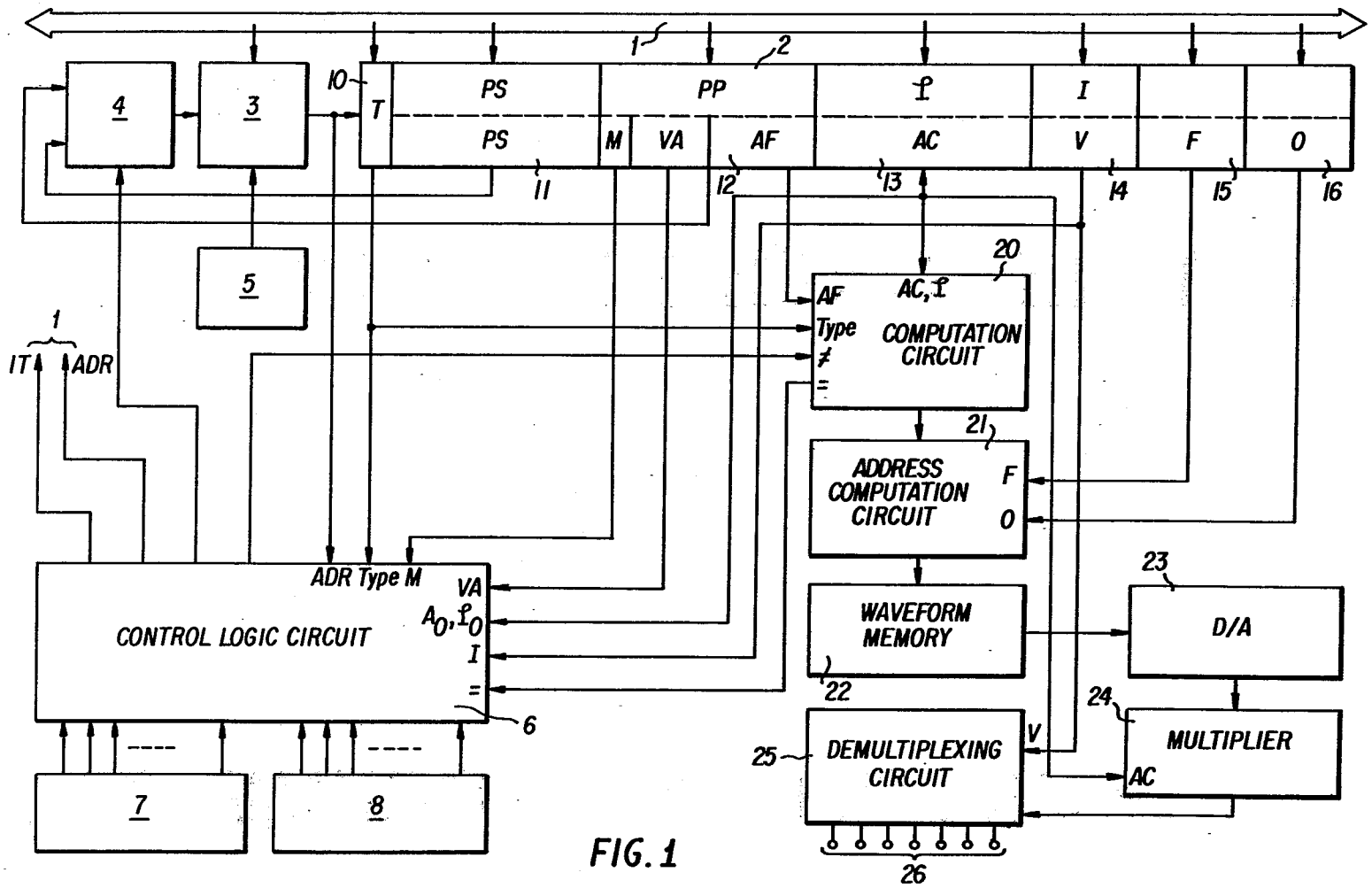
FIG. 1 is a block diagram of the general structure of a synthesizer according to the invention.

Referring now to the drawings, wherein like reference numerals designate identical or corresponding parts throughout the several views, and more particularly to FIG. 1 thereof, the synthesizer of the invention includes as an essential element "virtual keyboard" 2, which is a set of memory blocks, each containing digital parameters used for generating a sample of a periodic signal. The virtual keyboard consists, for example, of a memory composed of 256 blocks of 7 memories each. The contents of each of the memories of the blocks will be set forth clearly in the following. The blocks are read one by one, sequentially and according to a given series. The contents of the seven memories of each block are read simultaneously and applied to the other circuits of the synthesizer. They occasion the production of a sample and/or the updating of a datum contained in the virtual keyboard (running amplitude, instantaneous phase).

The virtual keyboard is therefore the basic element of the synthesizer since it contains both the data necessary for the production of successive samples of elementary signals and address pointers enabling sequential reading of the blocks in a given series. The position of each block in the virtual keyboard is defined by an address. This position may vary. It is decided by the synthesizer's outside control means. The position of each datum in a block is, by contrast, constant, with each memory coupled to one or more specific circuits of the synthesizer.

There are therefore two types of blocks in virtual keyboard 2: main blocks and secondary blocks.

Each main block contains an instantaneous phase value Ψ which is automatically incremented in substantial synchronization with the signal of a generator designated within the block by a number I. The block also contains a primary pointer PP, i.e. the address of another main block, a secondary pointer PS, i.e. the address of a secondary block, and a block type identification bit T (e.g. T=1 for a main block). Each secondary block contains digital data relating to octave O, wave form and type F, analog output path selection V, running amplitude AC, final amplitude AF, and selection of amplitude clock generator VA. It further contains a bit M for validation or restriction of automatic amplitude development, a secondary pointer PS, i.e. the address of another block (either main or secondary), and a block type identification bit T (T=0 for a secondary block).

Memory 10 contains the bit for identification of each type of block (T=1 or 0).

Memory 11 contains secondary pointer PS for the two types of blocks.

Memory 12 contains either primary pointer PP, where a main block is concerned, or data M, VA and AF where a secondary block is concerned.

Memory 13 contains either instantaneous phase Ψ (main block) or running amplitude AC (secondary block). This particular memory enables the circuits for incrementation of phase Ψ and variation of amplitude AC to be combined, these circuits having the same connection to the virtual keyboard.

Memory 14 contains either frequency generator number I (main block) or output path number V (secondary block).

Memories 15 and 16 contain respectively either the numbers for waveform F or octave O where a secondary block is concerned, or no significant data, in the case of a main block. These positions are of course available for containing data for eventual supplementary operations.

The significance of the data delivered by virtual keyboard V thus depends on the type of block read, i.e. on indicator T read in memory 10. The unfolding of operations within the synthesizer is thus directly tied to the reading of the blocks according to a set series, or chain, as described with reference to the following FIG. 5.

This unfolding is automatic, but it is nevertheless conditioned by the content of memories 11 and 12 (pointers), and determined by the control means of the instrument (not shown) and by the rectangular signals of a certain number of generators.

The control means of the musical instrument (not shown) communicate with the synthesizer through a set of connections called a "bus" 1. The controls of the synthesizer thus amount to read and write operations in the virtual keyboard from bus 1.

Selection of the blocks of the virtual keyboard is made by an address register 3, likewise connected to bus 1. This register is, in fact, a buffer register supplied with an address furnished either by the bus or by a selector circuit 4 which receives the two address pointers of the virtual keyboard, primary pointer PP of memory 12 and secondary pointer PS of memory 11. Selection depends on a selection control signal delivered by command logic 6 of the synthesizer. Turnover of the addresses in buffer register 3 occurs at the rhythm of a clock 5 or of a clock or control signal which determines the frequency of recurrence of the block read operations and consequently the frequency of production of samples of the elementary signals. However, the choice and order of production of the samples depends both on the content of the memory blocks, particularly the pointers, and on rectangular signal generators 7 and 8.

A set of generators 7 of rectangular signals determines the frequencies of the synthesizer's elementary signals. Set 7 contains at least 12 generators, the frequencies of which are fixed and distributed over a chromatic range. Generally, set 7 contains other generators, e.g. controllable frequency generators, enabling the synthesizer to produce signals of variable frequencies as well as special effects. These generators are connected to control logic 6 which, in keeping with the sequence for reading the blocks of virtual keyboard 2, detects changes in state in the generators and orders the updating of phase data Ψ and the production of analog samples.

A set of generators 8 determines the speed of amplitude development of the elementary signals. The frequencies of generators 8 are very low (several hertz to several hundred hertz). These generators are likewise connected to control logic 6, which, again in keeping with the sequence for reading the blocks of the virtual keyboard, detects generator state changes and orders the updating of amplitude data AC.

In order to do this, the control logic receives, in addition to signals from generators 7 and 8, block type identification bit T, the current address delivered by register 3, validation bit M, speed VA for selection of one of generators 8, number I for selection of one of generators 7, the least significant bit ($\Psi_o$ or $A_o$) of the current phase Ψ or amplitude datum AC, and a signal "=" indicating the equality AC=AF.

Depending on the state of all of these signals, logic 6 delivers an order "≠" for updating the current datum Ψ or AC, an order for selection of a primary or secondary pointer to selector 4, and call signals IT and ADR for the synthesizer's outside control means, through BUS 1.

The generation of elementary tones by successive samples is thus done from the above-mentioned control signals (T, ≠) and the date read in the virtual keyboard.

Computation circuit 20 performs either the incrementation and memorization of phase Ψ or the updating of current amplitude AC as a function of final amplitude AF.

An address computation circuit 21 receives phase and waveform and octave numbers F and O, and delivers an address which is applied to a waveform memory 22. The latter delivers a digital instantaneous amplitude sample (or amplitude variation sample) to a digital-analog converter element 23. The analog sample obtained is multiplied, in circuit 24, by the digital current amplitude datum AC and the result applied to a demultiplexing circuit 25 controlled by path selection datum V. Circuit 25 includes several analog output paths 26 intended to be connected to amplifiers through filtering and amplitude adjustment circuits which are not shown.

Circuits 21 to 25 are constructed very simply. Circuits 21 and 22 are read only memories, for example. Circuits 23 and 24 consists, for example, of two digital-analog converters connected in series, the output of one being connected to the reference input of the other. Circuit 25 is a demultiplexing circuit.

Figure 2:
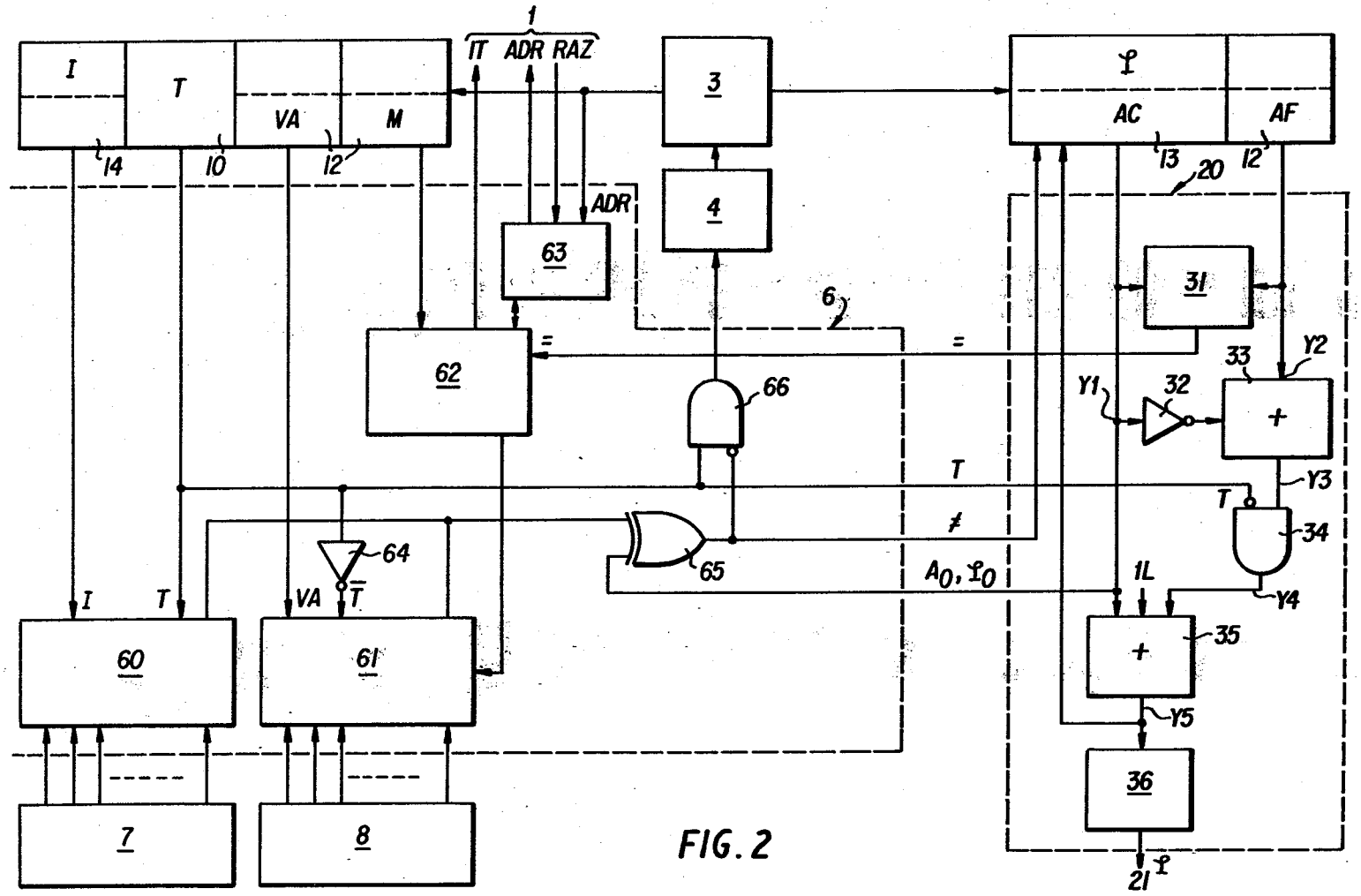
FIG. 2 is a detailed circuit diagram of the automatic amplitude development circuits and the control circuits of the invention.

FIG. 2 represents the details of control logic 6 and of circuit 20 for updating phase and amplitude data.

These circuits function from data read in the virtual keyboard, of which only memories 14, 10, 12 and 13 have been represented, along with address register 3 and selector 4.

The control logic comprises two multiplex circuits 60 and 61. Circuit 60 receives the rectangular signals delivered by the series of generators 7 (e.g. 16 different frequencies) which determine the frequencies of the periodic output signals. Circuit 61 receives the rectangular signals of the series of generators 8 (e.g. eight frequencies) which determine the speed of development of the amplitude of the periodic signals.

Multiplexer 60 therefore outputs the rectangular signal designated by the number I delivered by memory 14 when the block read is a main block (T=1). If not, i.e., if T=0, the output is disconnected (high impedance). Similarly, multiplexer 61 receives datum VA from memory 12 and delivers the signal from the corresponding generator when T=0. In order to do this, datum T (one bit) is applied directly to circuit 60 and, through an inverter gate 64, to circuit 61. The two multiplexer outputs are connected to one input of an exclusive-OR gate 65, the other input of which receives the least significant bits $\Psi_o$ (if T=1) or $A_o$ (if T=0). The output of gate 65 thus delivers an active ≠ signal if the states of the input signals are different and an inactive signal if they are identical. Each time the "≠" signal is active, it induces an updating of phase datum Ψ or amplitude datum AC (incrementation of the phase or interpolation of the amplitude). This updating must be performed in such a way that the least significant bit of Ψ OR AC is always identical to the state of the generator selected by one of the multiplexers. As long as there is equality, gate 65 will not order an updating.

This updating is carried out by circuit 20, which comprises:

a first three-input, eight bit adder 35. A first input is connected to memory 13 and thus receives phase Ψ (if T=1) or current amplitude AC (if T=0). A second input permanently receives a logic state 1 (1L). A third input is connected to the output of an AND circuit 34;

a second two-input, four bit adder 33. A first input receives the four most significant bits of memory 13 following inversion by an inverter 32. A second input receives the four bits of final amplitude AF. The output of adder 33 is connected to a non-inverting input of AND circuit 34. The other input of AND 34 is inverting and receives signal T;

a comparator circuit 31 receiving the contents of memories 12 and 13 delivering an "=" signal as soon as there is identity.

For the operation of circuit 20, two cases are possible, according to the value of T:

If T=1, the data read in memory 13 is phase Ψ. The binary state of the output of AND 34 is still 0. Consequently, the output of adder 35 delivers Ψ+1. This datum is placed in memory in a register 36 so as to be available (for circuit 21) when the datum read in memory 13 is amplitude AC. Datum Ψ+1 is likewise registered in memory 13 in place of preceding datum Ψ. The order of memorization is given by the "≠" signal delivered by exclusive-OR 65.

If T=0, it is datum AC which is delivered by memory 13. The four most significant AC bits at input $Y_1$ of circuit 32 represent AC/16. Considering similarly that datum $Y_2$ at the input of adder 33 is AF/16, since memory 12 has only 4 bits, adder 33 delivers:

$$Y_3 = Y_2 - Y_1 = (AF - AC)/16 - 1$$

This datum is applied to adder 35 across AND 34, which is open when T=0, with a left shift of one bit, corresponding to a multiplication by two:

$$Y_4 = 2Y_3$$

The output of adder 35 thus delivers:

$$Y_5 = AC + Y_4 + 1 = AC + 2(AF - AC)16 - 1$$

This operation performs two functions:

a logarithmic interpolation between AC and AF:

a reversal of least significant bit $A_o$, since the quantity added, 2(AF−AC)/16−1, is odd.

Control logic 6 further comprises an AND circuit 66 performing $Tx\overline{\neq}$ in order to control selector circuit 4. In fact, as long as ≠ is in state 0, the type of block selected does not change, as long as the states of generators 7 do not change, the blocks read remain main blocks, and no sample is computed. If the reading of a series of secondary blocks is in question, T=0 and the "≠" signal has no effect on selector 4. The series of secondary blocks follows its sequence until a main block appears, as will be explained below.

The control logic further comprises an address memory 63 intended to register the address of the block in which there exists the equation AC=AF. In order to do this, the "=" signal delivered by comparator 31 is applied to a logic circuit 62 intended to govern the end of amplitude development in each block. This circuit receives signals T, M (1 bit), "=", and address ADR in memory 63. It delivers memorization control signals to memory 63, multiplexer M blocking signals, and IT interruption signals to the synthesizer's outside control circuits through BUS 1. The IT signal is accompanied by the contents ADR of memory 63. The latter also receives through bus 1 a signal RAZ for clearing its contents. Logic 62 is made up simply of a programmable network (read only memory). The outputs deliver control signals as a function of input signals in accordance with the following truth table, in which the symbol x means "don't care, 1 or 0":

| M | T | ADR | = | Commands |
|---|---|---|---|---|
| 1 | x | x | x | No command |
| x | 1 | x | x | No command |
| 0 | 0 | ≠0 | x | Transmission of IT<br>No memory in 63<br>Blocking of multiplexer 61 |
| 0 | 0 | =0 | 0 | No IT signal<br>No memorization in 63<br>Unblocking of multiplexer 61 |
| 0 | 0 | =0 | 1 | Transmission of signal IT<br>Memorization of ADR in 63<br>Blocking of multiplexer 61 |

Figure 3:
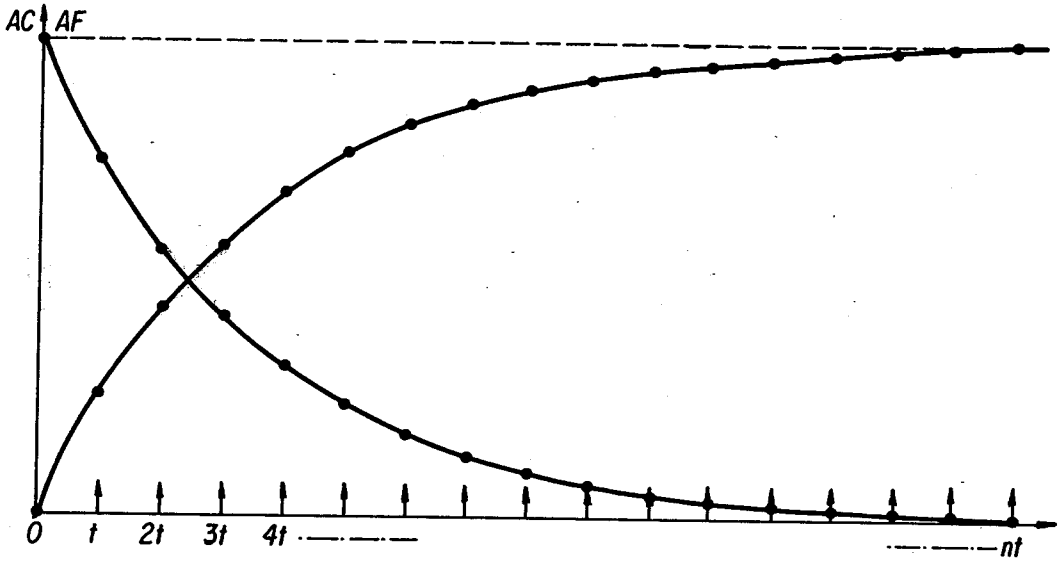
FIG. 3 is a graph illustrating an amplitude development curve running from an initial to a final value.

FIG. 3 represents the automatic development of the amplitude of a periodic output signal over time t from an initial amplitude to a final amplitude. It shows an increasing signal and a decreasing signal. The amplitude of each signal in fact develops by steps. The points on each curve indicate the new running amplitude $AC_{(n+1)t}$ calculated from the running amplitude at the preceding point $AC_{nt}$ and final amplitude AF, according to the formula:

$$AC_{(n+1)t}=AC_{nt}+(AF-AC_{nt})/k$$

with the coefficient k preferably being a power of 2 (k=4 in the case of the Figure).

Figure 4:
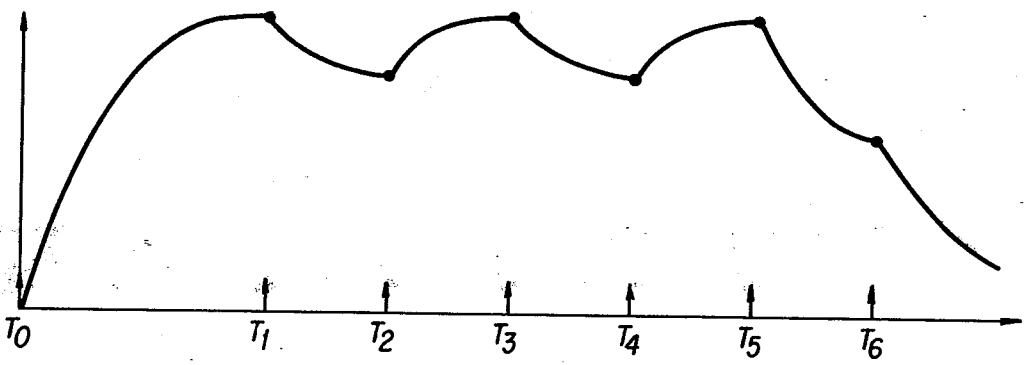
FIG. 4 is a graph illustrating a complete curve of the development of the amplitude of a sound component.

FIG. 4 represents the amplitude envelope curve of a periodic signal. This curve comprises a leading section $t_0$–$T_1$ where the amplitude is rising, a section $T_1$–$T_5$ where the signal undergoes an amplitude tremolo, and a section $T_5$–$T_6$, etc., involving diminution and extinction of the signal. It should be noted that this complex evolution of amplitude requires only a few amplitude commands (writing new value AF), at instants T1, T2, T3, etc.

Figure 5:
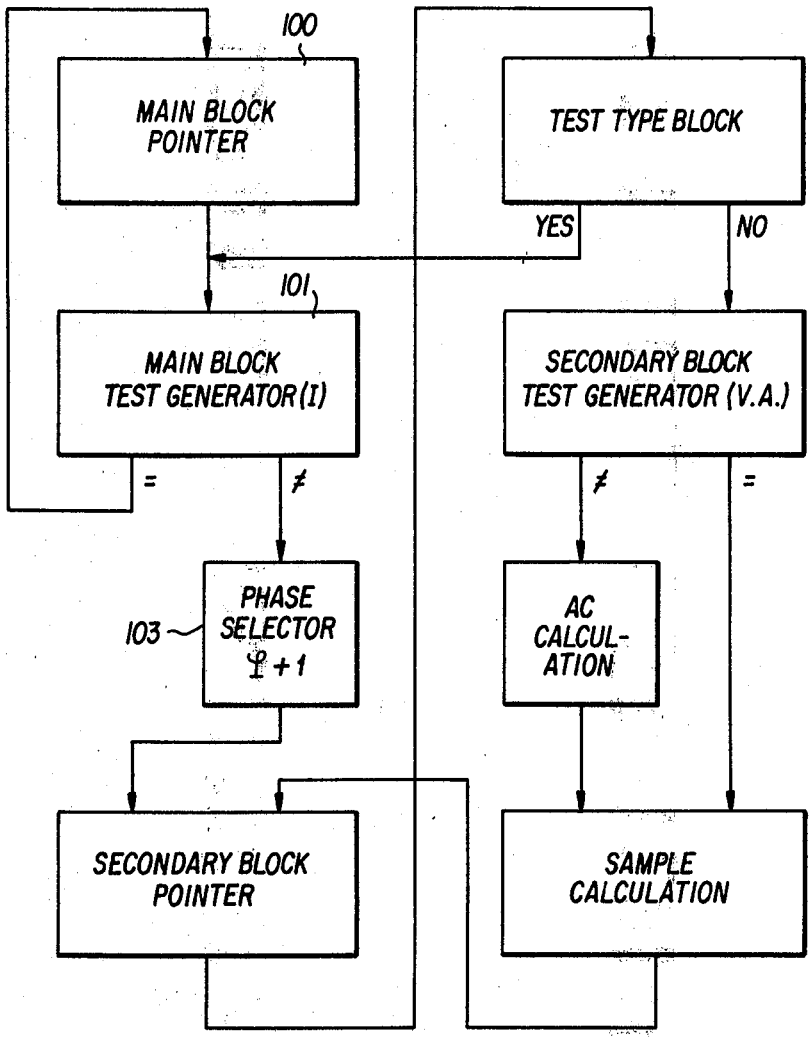
FIG. 5 is a flow chart explaining the progress of operations within the synthesizer.

FIG. 5 is a flow chart explaining the unfolding of the sequence for reading of blocks within the synthesizer.

As long as the state of the signals from generators 7 does not change, reading of main blocks proceeds without production of any samples, along loop 100-101-100, etc., which comprises selection of a principal pointer 101, reading of a designated main block (100), and a test of the generator designated by the number I which it contains. If the state of a generator changes (≠), phase Ψ of the main block is incremented (103). The following block, designated by the secondary pointer (102), is first made the object of a test (104). If this block is a main one, there is a return to 101; if it is not a main one, the state of generator 8 designated by datum $V_A$ is tested (105).

A sample is then computed automatically (107), either using the running amplitude value AC already contained in the block (if there is state change as indicated by the "=" sign) or using a new running amplitude (if "≠") computed (106) according to a logarithmic (or exponential, or linear) interpolation. Then a new block is selected by the secondary pointer (102) and so on.

The invention is applied to electronic musical instruments of which it constitutes the principal element. In fact, the production of an instrument such as an electric organ requires other elements surrounding the synthesizer, such as cabinet, keyboards, pedals, electric power supply, low frequency amplification and synthesizer control logic. This control is advantageously composed of a microcomputer, of which the synthesizer according to the invention is a peripheral. This microcomputer, moreover, is very simple and comprises a microprocessor connected to program memories, data memories, and logic circuits making the necessary connections with keyboards, pedals, buttons, stops, etc., as well as with the synthesizer. Several synthesizers may even be coupled to one microcomputer and vice-versa.

By automatically carrying out the automatic development of the envelope of each periodic signal up to a final amplitude value, the synthesizer according to the invention frees the microcomputer from the corresponding task. The complexity of the synthesizer is not substantially increased, however, since the phase incrementation and amplitude computation circuits are joint, with the characteristic that each updating operation of phase or amplitude adds an odd quantity to the preceding value, so that the least significant bit may follow the state of a generator. Other equivalent means are obviously foreseeable. It should also be noted that the automatic amplitude development of each periodic signal is independent of that of other signals. Thus, certain periodic signals may be modified from time to time by the control means of the instrument while others may keep the same amplitude, in two possible ways, either by ignoring the IT signal transmitted by control logic 6, or by placing a mask M in memory 12 of the virtual keyboard. This mask M prevents logic 62 from transmitting an IT signal to the microprocessor, but does not prevent the operation of the means (20) for updating the running amplitude. The running amplitude value meanwhile remains constant and equal to AF. Mask M may also be used to block the operation of updating means 20.

Obviously, numerous additional modifications and variations of the present invention are possible in light of the above teachings. It is therefore to be understood that within the scope of the appended Claims, the invention may be practiced otherwise than as specifically described herein.

What is claimed as new and desired to be secured by Letters Patent of the United States is:

1. A polyphonic digital synthesizer of periodic signals comprising:

plural generators for generating binary signals of predetermined frequencies;

a set of memory blocks containing amplitude data including current amplitude data and final amplitude data;

control means for reading the memory blocks according to a set sequence as a function of said binary signals;

means for producing analog samples of periodic signals from data read from the memory blocks, comprising;

means for automatic development of the amplitude of each periodic signal, comprising computing means for periodically replacing each current amplitude datum with an updated current amplitude datum computed by interpolation from a current amplitude data and a final amplitude data read from said memory blocks;

each memory block further comprising a validation datum M, and said control means comprising means for disabling the automatic development of the updated current amplitude data of the corresponding periodic signal in case of absence of the validation datum M; and said computing means comprising means for producing an updated current amplitude datum which is a quasilogarithmic interpolation between the current amplitude datum and the final amplitude datum read in the corresponding block.

2. A synthesizer according to claim 1, further comprising:

said computing means of said means for automatic amplitude development comprising, at least one system clock generator delivering a binary signal, means for producing an updated current amplitude value by interpolation between the current amplitude data and final amplitude data of each block read, and storage means for storing the updated current amplitude data in place of the current amplitude data; and second control means for controlling in substantial synchronization with the binary signal of the system clock generator the computation of said updated current amplitude data by said computing means and storage thereof by said storage means.

3. A synthesizer according to claim 1, further comprising:

said second control means synchronized with the first control means for reading of blocks in order to control computation of updated current amplitude data only when a block containing amplitude data is selected by the first means and when a change in state of the system clock generator is detected.

4. A synthesizer according to claim 1, wherein said computing means comprises:

a computation circuit for computing a fraction of the difference between the current amplitude data and the final amplitude data;

said computation means comprising an adder having a first input for receiving the current amplitude datum (AC), a second input coupled to the output of said computation circuit, and an output coupled to the set of memory blocks so as to deliver said updated current amplitude data.

5. A synthesizer according to claim 1, further comprising:

a comparator circuit for comparing the final amplitude datum and the current amplitude datum (AC) in order to produce a signal indicating identity.

6. A polyphonic digital synthesizer of periodic signals comprising:

plural generators for generating binary signals of predetermined frequencies;

a set of memory blocks containing instantaneous phase data and amplitude data including current amplitude data and final amplitude data;

first control means for reading the memory blocks according to a set sequence as a function of said binary signals;

means for producing analog samples of periodic signals from data read from the memory blocks, comprising, means for automatic development of the amplitude of each periodic signal, comprising computing means for periodically replacing each current amplitude datum with an updated current amplitude datum computed by interpolation from a current amplitude data and a final amplitude data read from said memory blocks;

each memory block further comprising a validation datum M, and said control means comprising means for disabling the automatic development of the updated current amplitude data of the corresponding periodic signal in case of absence of the validation datum M;

a plurality of system clock generators, each memory block comprising in addition to current and final amplitude data, a datum (VA) for selection of a system clock generator;

said control means further comprising means for selection of a system clock generator, controlled by the selection datum (VA) read in the corresponding block;

the set of memory blocks comprising main blocks, secondary blocks, and a block indicator (T) for selecting either said main blocks (T=0) or said secondary blocks (T=1), each main block comprising an instantaneous phase datum (Ψ) common to the computations of several analog samples, and a datum for selection (I) of a binary signal generator, each secondary block comprising current and final amplitude data (AC and AF, respectively), and a datum for selection (VA) of a system clock generator;

wherein either the instantaneous phase data (Ψ) of the main block or the current amplitude data (AC) of the secondary block is output at a predetermined common output location of said set of memory blocks based on selection by said block indicator (T) coincide; and wherein said computing means computes and memorizes an updated instantaneous phase value (Ψ), increased by one unit over the preceding, in the case of the reading of a main block and a change in state of the binary signal of the system clock generator designated by the selection datum (I) contained in said main block, and computes and memorizes said updated current amplitude datum in place of the current amplitude datum, in the case of the reading of a secondary block and a change of state in the binary signal of the system clock generator designated by the selection datum (VA) contained in said secondary block.

7. A synthesizer according to claim 6, characterized in that the computing means comprise:

a circuit for computation of a fraction of the difference between the final amplitude datum (AF) and the current amplitude datum (AC);

an adder circuit having a first input for receiving either the current amplitude datum (AC) in the case of the reading of a secondary block, or the instantaneous phase value (Ψ) in the case of reading a main block, a second input for receiving a constant logic level, and a third input for receiving the data delivered by computation circuit through a logic gate connected in such a way that the datum applied to the third input is always even, the gate being controlled by block type indicator signal (T=1, T=0) in such a way as to deliver a zero quantity during reading of a main block and to be enabled during reading of a secondary block; and a phase memory register for storing the updated current phase datum delivered by the adder during reading of a main block.

* * * * *